US009006591B2

(12) United States Patent
Williamson et al.

(10) Patent No.: US 9,006,591 B2
(45) Date of Patent: Apr. 14, 2015

(54) APPLIANCE CONTROL KNOB SUPPORT

(71) Applicant: Electrolux Home Products, Inc., Charlotte, NC (US)

(72) Inventors: Mark David Williamson, Ames, IA (US); Chris H. Hill, Ames, IA (US)

(73) Assignee: Electrolux Home Products, Inc., Charlotte, NC (US)

( * ) Notice: Subject to any disclaimer, the term of this patent is extended or adjusted under 35 U.S.C. 154(b) by 163 days.

(21) Appl. No.: 13/675,315

(22) Filed: Nov. 13, 2012

(65) Prior Publication Data

US 2014/0131180 A1 May 15, 2014

(51) Int. Cl.

*H01H 19/11* (2006.01)
*H01H 19/02* (2006.01)
*H01H 11/00* (2006.01)

(52) U.S. Cl.

CPC ..... *H01H 19/02* (2013.01); *H01H 11/00* (2013.01)

(58) Field of Classification Search

USPC ..... 200/11 R, 564; 403/26; 74/813 R, 553; 292/348
IPC ..... G05G 1/08,1/10; H01H 19/02, 19/04, H01H 19/08, 19/10, 19/14
See application file for complete search history.

(56) References Cited

U.S. PATENT DOCUMENTS 5,083,477 A 1/1992 Geil
5,093,959 A 3/1992 McTargett et al.
5,216,781 A 6/1993 Brondfield
5,363,720 A 11/1994 Sanchez
5,464,955 A 11/1995 Cole
5,509,174 A 4/1996 Worrell
5,741,003 A 4/1998 Segien, Jr.
5,810,161 A * 9/1998 Carroll, Jr. ..... 200/296
5,861,589 A 1/1999 Sato et al.
6,062,616 A 5/2000 Smolarski
6,396,006 B1 5/2002 Yokoji et al.
6,635,831 B2 10/2003 Kato
6,709,188 B2 3/2004 Ushimaru
6,797,907 B1 9/2004 Meagher et al.
6,805,020 B2 10/2004 Onodera
7,038,156 B2 5/2006 Kim et al.
7,171,728 B2 2/2007 Chirumbolo
7,479,607 B2 1/2009 Sack et al.
7,579,559 B2 8/2009 Schelbert et al.
7,908,713 B2 3/2011 Yoshinaka et al.
7,928,334 B2 4/2011 Kramlich
2003/0024796 A1 2/2003 Peterson et al.
2006/0000698 A1 1/2006 Yoon et al.

(Continued)

FOREIGN PATENT DOCUMENTS

JP 2006-210288 8/2006
KR 20070088210 8/2007
WO 2010/116206 10/2010
WO 2010/116207 10/2010

*Primary Examiner* — Vanessa Girardi
(74) *Attorney, Agent, or Firm* — Banner & Witcoff, Ltd.

(57) ABSTRACT

An appliance control knob assembly includes an encoder with a rotatable shaft. A control knob is connected to the shaft and is mounted on a protuberance that extends into the control knob and provides a bearing mounting surface. The control knob has a hub portion rotationally supported by a bearing mounted within the protuberance, and which engages the rotatable encoder shaft. The encoder is mounted such that prior to attachment of the hub portion with the encoder shaft, the encoder is allowed a degree of movement to come into alignment with the hub portion.

18 Claims, 6 Drawing Sheets

(56) References Cited

U.S. PATENT DOCUMENTS

2007/0193865 A1 8/2007 No et al.
2010/0043499 A1* 2/2010 Choi et al. ..... 68/13 R
2010/0147095 A1 6/2010 Eckert et al.
2011/0061489 A1 3/2011 Bulin et al.

* cited by examiner

APPLIANCE CONTROL KNOB SUPPORT

BACKGROUND OF THE INVENTION

The present invention relates to appliance control knob assembly constructions, and particularly to constructions of control knobs for use in laundry appliances, such as automated laundry washing machines and dryers.

Automated laundry appliances (such as laundry washing machines and dryers) typically include an external generally rectangular cabinet, a control panel for controlling the washer/dryer operation, and a hinged lid or door that may be swung open to provide top or front-load access to a rotatable cylindrical wash basin (in the case of a washer). In use of an automated laundry washing machine, after placing a load of laundry in the wash basin, along with a suitable type and quantity of laundry detergent, a wash process is initiated by an operator through interaction with the control knob. Similarly, with a dryer, a wash load drying process is initiated through interaction with a control knob. The control knob provides a user interface through which a user may make selections of cycles and various wash (or dry) control parameters. Controlled operation sequences may be carried out using an electronic controller that may, e.g., be provided as an integral part of the control panel, or mounted separately and suitably connected therewith. Such a controller may comprise one or more suitably programmed microprocessors or application specific integrated circuits (ASICs), operably connected to suitable circuitry, e.g., for driving the wash basin drive motor, actuating operation components (e.g., valves and a pump) to fill the wash basin and drain it, dispense additives, etc. Such operations will be carried out in accordance with commands of the controller, generated on the basis of program control and possibly also signals received from various sensors monitoring various operation-related parameters.

Many current designs for knobs in washer and dryer consoles comprise a knob shell with a concentric knob shaft on the inside that is supported on its outside diameter by either a cone shape that contacts the knob shaft only over a very small area close to the front face of the knob, or a cylindrical shape that holds the knob shaft over a larger area/length of the knob shaft.

The rearward end of the knob shaft often is supported by an encoder on an electronic circuit board. Alternatively, some knobs are supported only by an encoder. These designs can create problems of displacement of the knob from its intended aligned mounting position and friction between the knob shaft and the supporting geometry. Unwanted lateral movement of the knob may result from the gap necessarily provided between the knob shaft and the shaft support geometry to allow low friction rotation of the knob. This lateral movement may result in undesirable loosening of the knob or misalignment in relation to the encoder that may hinder knob operation. It may also provide an undesirable user feel. As that gap is increased, the lateral movement may allow the outermost diameter of the knob to rub on the surrounding console structure, causing more friction and wear. This issue is even more prevalent on designs where the knob is supported by only the encoder, as there is a much higher moment arm for any lateral forces (including gravity) to affect the position of the knob and allow it to rub on the console. Conversely, as the gap between the knob shaft and its support geometry is narrowed to reduce lateral knob movement, friction between the knob shaft and its support geometry may increase.

Axial movement of, or forces on, the knob also may be a problem. As the knob is pushed inward during use, it may frictionally engage against the knob shaft support geometry leading to undesirable increased rotation resistance. Axially directed forces on and/or movement of the knob can also cause damage to the encoder to which the knob shaft is attached. If the knob is pulled outward from the console during use, there also may be increased friction between the knob shaft and its support geometry. Also, there may be increased friction between the knob and the console. Small dimensional variations on any of the interacting parts, which are to be expected in injection molding processes, can have a great impact on any of these three potential issues.

SUMMARY OF SELECTED INVENTIVE ASPECTS

In view of the foregoing, it is an object of the present invention to provide a control knob assembly and method of assembly that avoids the drawbacks of prior control knob support arrangements. To this end, in an aspect, the present invention provides an appliance control knob assembly including an encoder that has a rotatable shaft. A control knob is connected to the rotatable shaft. A control knob mounting protuberance extends into the control knob and provides a bearing mounting surface. A bearing is mounted on the bearing mounting surface. The control knob has a hub portion extending through the bearing and engaging with the same so as to be rotationally supported therein. The hub portion further engages with the rotatable shaft of the encoder. The encoder is mounted within the assembly such that prior to attachment of the hub portion with the encoder shaft, the encoder is allowed a degree of movement. As a result, upon engagement of the hub portion with the encoder shaft, the encoder shaft comes into alignment with the hub portion.

In a further aspect, the invention provides a control knob assembly method. In that method, a bearing is mounted on a bearing mounting surface of a control knob mounting protuberance. A control knob is mounted on the mounting protuberance such that the protuberance extends into the control knob, and a hub portion of the control knob extends through the bearing. An encoder is movably mounted within a support structure of a control panel assembly. The encoder has a rotatable shaft. The hub portion is engaged with the encoder shaft such that the engagement is able to move the encoder within the support structure to thereby center the shaft with the hub portion in the event of a misalignment of the shaft and hub portion.

These and other objects, aspects and features of the present invention will be readily apparent and fully understood from the following detailed description taken in conjunction with the appended drawings.

DETAILED DESCRIPTION OF EXEMPLARY EMBODIMENTS

Figure 1:
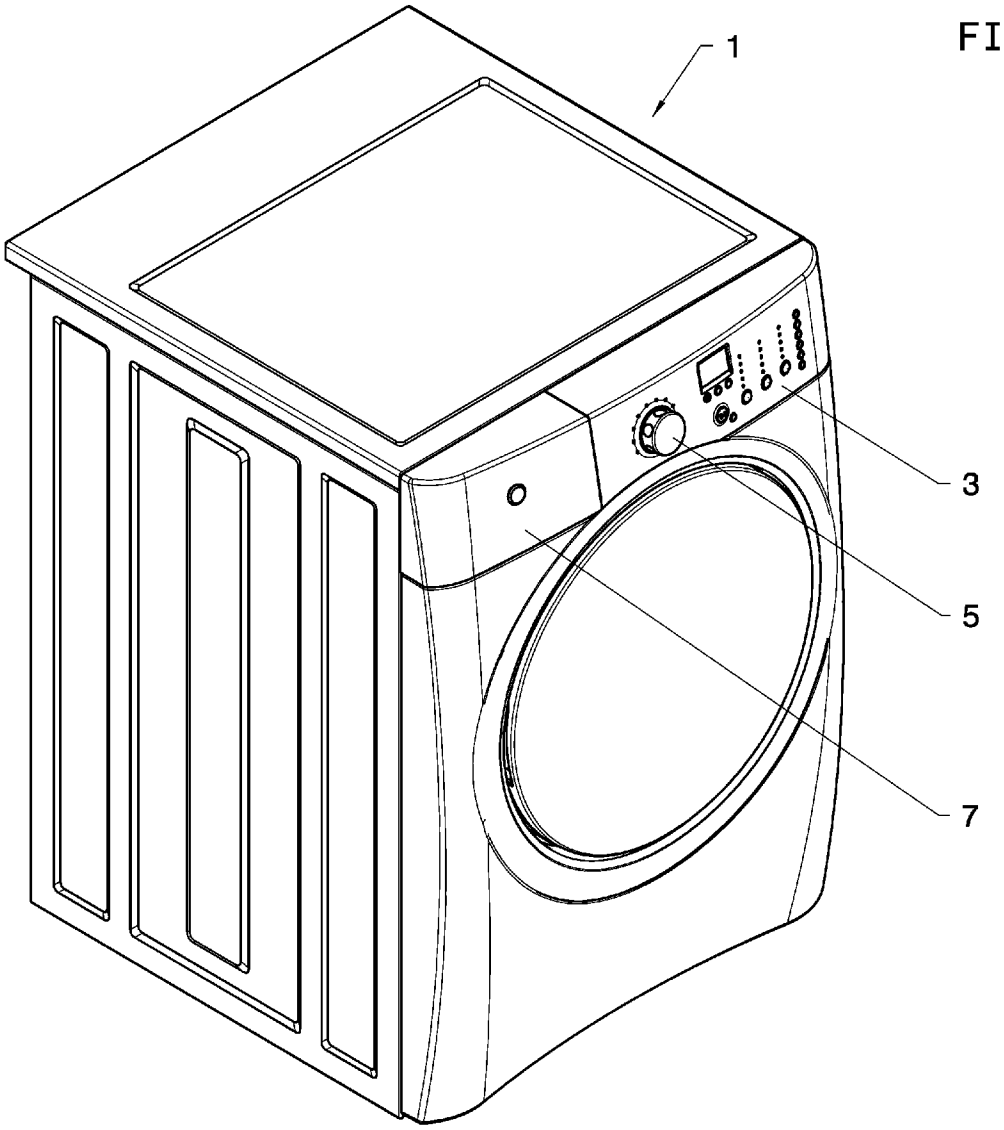
FIG. 1 is a frontal perspective view of a front load automatic laundry washer, including a control panel assembly in accordance with an aspect of the invention.

Referring to FIG. 1, illustrated is an exemplary laundry washing appliance (machine) 1 of the front-load, rotating drum variety. The washing machine 1 includes a control panel 3 with a control knob 5 and an assembly of a drawer 7 alongside the control panel 3. Drawer 7 is extensible out of the housing to permit a user access to additive retention compartments of the drawer.

Figure 2:
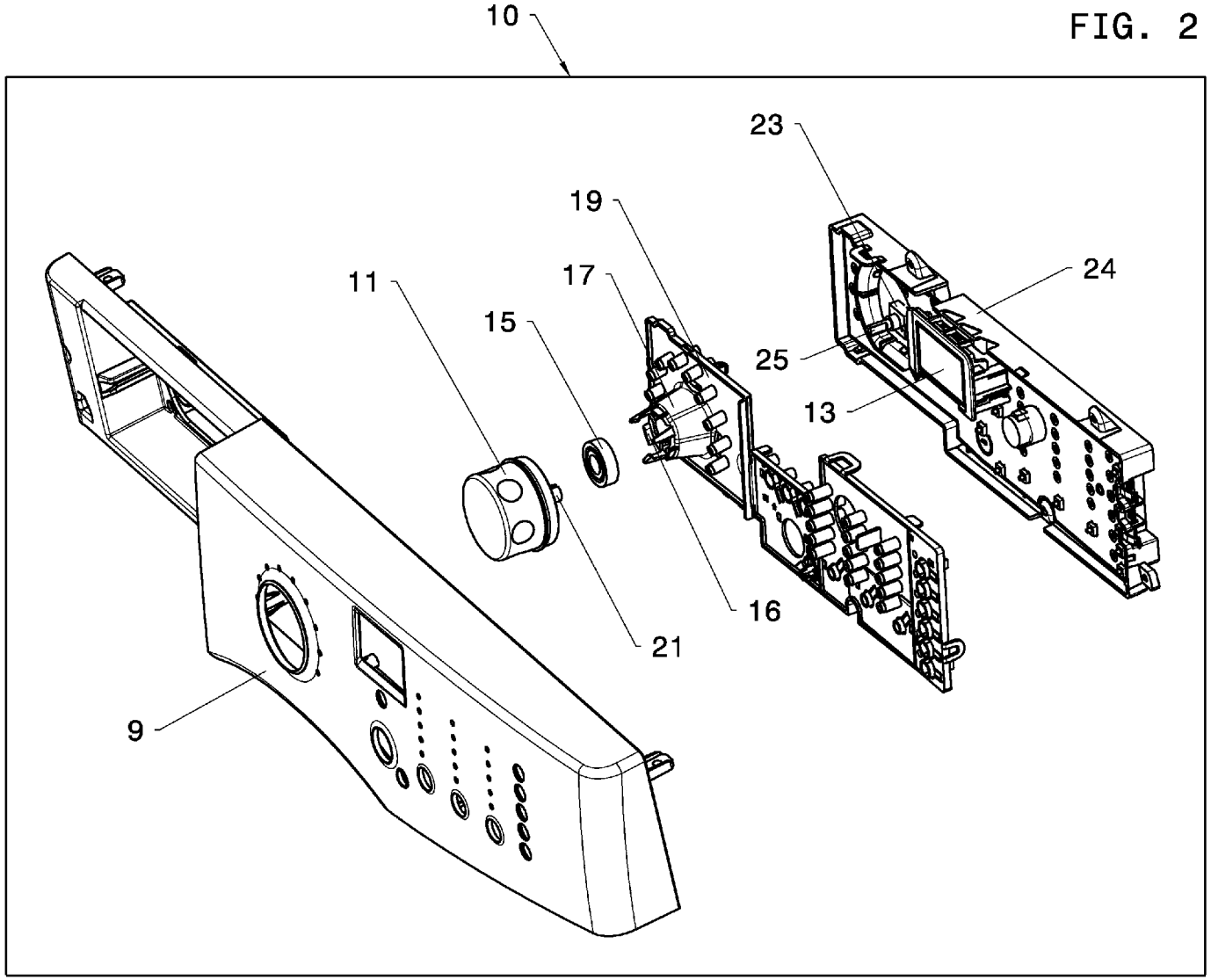
FIG. 2 is first level exploded perspective view showing a unitized assembly of control panel and knob parts in accordance with an aspect of the invention.

Referring now to FIG. 2, an exemplary control panel (and knob) assembly 10 in accordance with an aspect of the invention is shown. The assembly includes a front fascia or console 9, which spans the width of the appliance. Received within, or in registry with, various apertures formed in the fascia 9 are a control knob 11, an LCD display screen 13, and a plurality of operation push-buttons and illumination elements (not shown in FIG. 2, but visible on the face of control panel 3 in FIG. 1). The control panel assembly 10 illustrated in FIG. 2 generally corresponds to the control panel 3 seen in FIG. 1.

The illustrated control knob 11 is rotatable in order to permit the user to select operation cycle settings and other control parameters, with reference to selections indicated by words, icons, or other indicia that may be arrayed (in printed form or otherwise) on the fascia about the control knob, and/or used in conjunction with LCD display 13.

Figure 3:
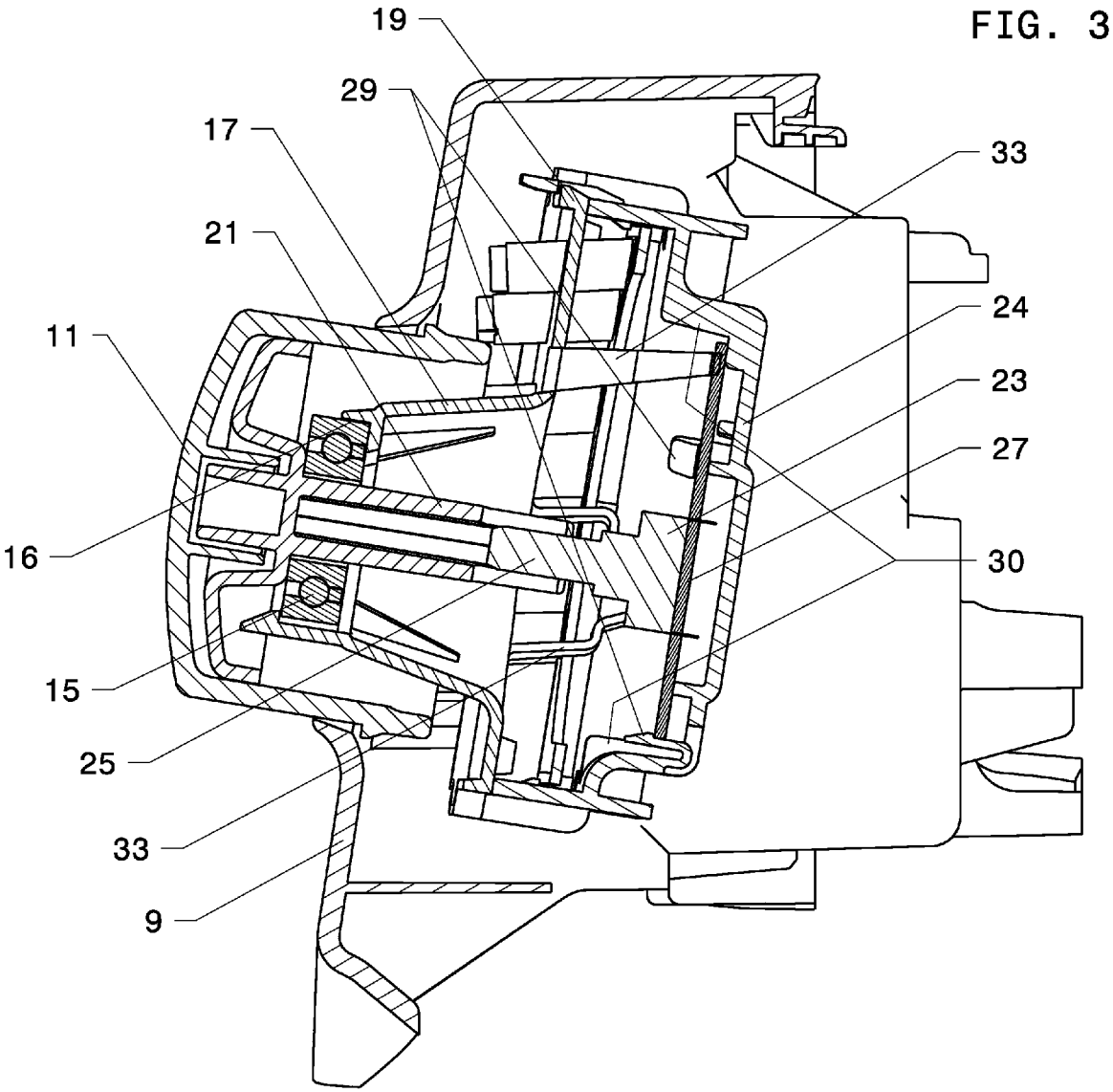
FIG. 3 is a cross-sectional view of the assembly of the control knob, bearing, and front housing unit engaged on its front with the control panel fascia, and on its rear side with the encoder mounted on the PCT retained within the control panel rear housing.

The assembly featured in FIG. 2 includes a generally toroidally shaped bearing 15 that mounts within a recessed seat 16 formed within a generally frusto-conical protrusion or mound 17 formed as part of a front housing 19 of the control panel assembly. Seat 16 provides a bearing mounting surface. Control knob 11 includes a hub portion including a knob shaft 21, and is mounted over the bearing 15 and the protrusion 17 such that the knob shaft 21 extends through the bearing. Bearing 15 may be of various known types suitable for rotationally mounting a shaft with low friction. In this instance, the bearing will rotationally mount the knob shaft 21 of the control knob 11, to thereby rotationally mount knob 11 in a highly stable, low-friction manner. Suitable bearings generally include rolling-element bearings, and more specifically ball bearings such as illustrated in FIG. 3. Other types of bearings that may be used include thrust bearings (encompasses all subsets of thrust bearings) and roller bearings (encompasses cylindrical roller, needle, tapered roller, and spherical roller bearings). ("Roller bearings" and "ball bearings" are both members of the set "rolling-element bearings".)

Also, as shown in FIG. 2, an encoder 23 is mounted in a rear housing 24 of the assembly, within a recessed cup-like portion thereof. Encoder 23 includes an encoder shaft 25 which engages with the knob shaft 21 upon assembly of the control knob. Encoder 23 may be mounted directly on a surface of the rear housing, or on a printed circuit board (PCB) 27 (see FIGS. 3-4), which is in turn mounted on/within the cup-like portion of the rear housing 24 (shown in FIG. 6 without the encoder 23 and PCB 27). Console 9 is mounted over (in front of) the rear housing 24, front housing 19 and about knob 11 in order to aid in the appliance's functionality and aesthetic appeal. Upon assembly and engagement of the encoder shaft 25 with the knob's central shaft 21, rotation of the knob may be used to select different options for operation of the appliance.

Figure 4:
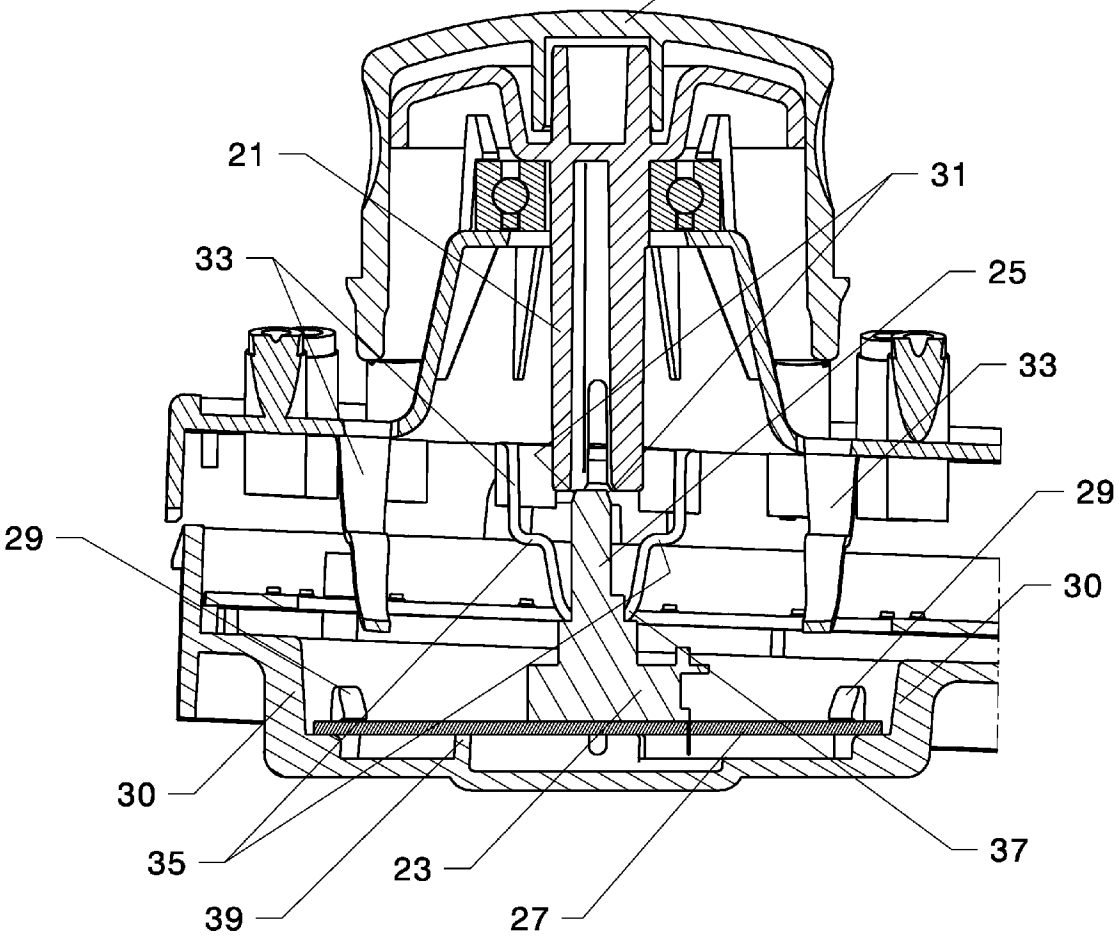
FIG. 4 is a cross-section taken through a central knob shaft of the control knob, upon initial engagement with a rotational shaft of the encoder.
Figure 6:
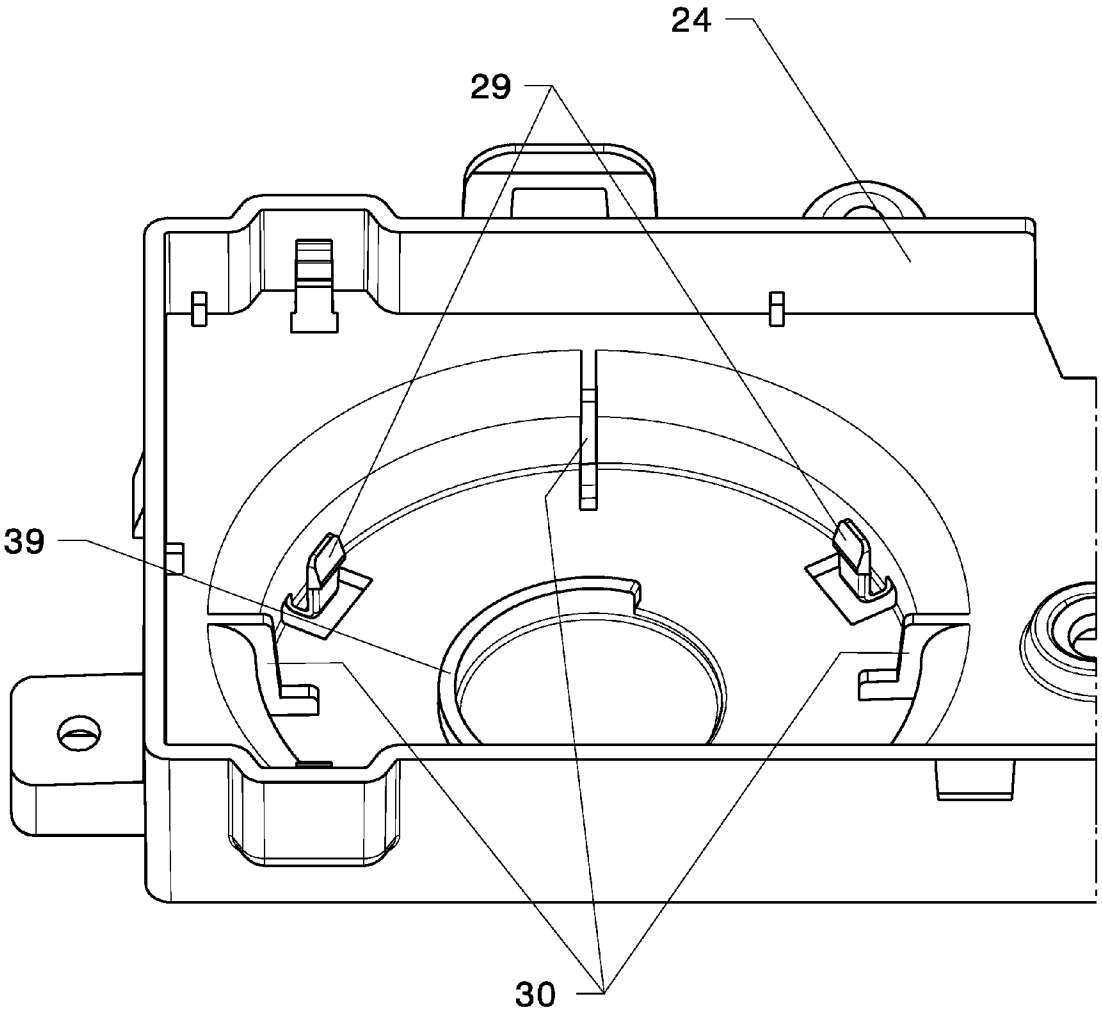
FIG. 6 is a partial perspective view of a recessed cup portion of the control panel rear housing within which the PCB-mounted encoder is retained.

As illustrated in FIG. 3, encoder 23 with its encoder shaft 25 may be mounted within rear housing 24. In the embodiment represented in FIG. 3, encoder 23 is first mounted on (or comes mounted on) PCB 27. The PCB is configured and mounted within the rear housing so as to provide a degree of float or play side-to-side and up and down (with reference to an installed orientation), in the plane of the PCB 27. The PCB may be mounted thusly by one or more encoder board spring clips 29 (also seen in FIG. 6) such that a small gap is formed between an edge of the PCB 27 and a rear housing alignment rib or wall 30, as best seen in FIG. 4. (Ribs 30 are also shown in FIG. 6.) This degree of float or play, that may be against the light spring action of clips 29 (if provided), allows the PCB 27 to move upon engagement of the knob shaft 21 with the encoder shaft 25 so that the shaft 25 may be properly and centrally aligned and inserted within the central bore/passage of knob shaft 21. This facilitates mounting of the knob within the assembly and avoids stresses on the encoder 23 and the control knob 11.

Prior to the engagement of the knob shaft 21 with the encoder shaft 25, the control knob 11 is mounted within a bearing which is mounted within the mound-like, frusto-conical protrusion 17, that may be formed (e.g., injection molded) as part of the front housing 19. The illustrated embodiment employs a ball bearing 15. In a known manner, the bearing 15 has a generally toroidal shape formed by a pair of concentric rings/races with circumferential troughs that face each other to form therebetween a raceway within which a set of balls is rotatably trapped to rotate and orbit, thereby providing a low friction rotatable mount of the inner ring/race within the outer ring/race of the bearing. The rings/races and balls may be made of various materials including either metal or plastic, and may employ a wet or dry lubricant to further reduce friction and facilitate smooth rotational movement.

Ball bearing 15 may be press-fit into a collar formed by a central circular cavity 16 formed within the protrusion 17. This fixes the outer ring of the bearing with respect to the protrusion, while rotationally mounting the inner ring. The central shaft of the knob 21 may then be press-fit into the inner ring of the bearing. This press-fitting arrangement positively establishes the translational position and orientation of the knob relative to the front housing 19. The relative movement afforded by the mount of the encoder 23 within the rear housing 24 allows the encoder shaft to come into alignment with that position. Thus, the misalignment problems associated with prior designs, where the knob position is at least in part dependent on the (non-movable) encoder position. Moreover, the mount can be made much stronger than prior designs that rely on only the encoder shaft for support.

Crush ribs may be used to effect the press-fit of the outer race ring of the ball bearing firmly within the recess of protrusion 17, and also to effect the press-fit of the knob shaft firmly within the inner race ring of the ball bearing so that the only movement of the knob relative to the front housing is rotation within the ball bearing.

As illustrated in FIG. 4, the knob shaft 21 and/or encoder shaft 25 may include one or more chamfers 31 to aid in the alignment of the two elements and entry of the shaft end into the knob shaft passage. In one embodiment, the encoder shaft has a D-shaped cross-section, as does the mating passage of knob shaft 21. Upon initial engagement of the encoder shaft 25 with the central passage of the knob shaft 21, the encoder shaft may not be centrally aligned with the knob shaft passage. As such, the edges of the encoder shaft may touch the sides of the knob shaft passage. The chamfers 31 allow for guidance of the encoder shaft 25 into the center of the knob shaft 21 upon engagement. As the PCB 27 is allowed a degree of float, the encoder (and its shaft 25) may move into proper alignment.

During the assembly, a sub-assembly of the knob 11, bearing 15, and front housing unit 19 may be engaged as a unit with rear housing 24. In this process, encoder shaft 25 engages with and advances into knob shaft 21, coming into alignment therewith due to the float afforded by the mount of the PCB 27. At the same time, PCB 27 becomes fixed in its aligned position by virtue of hold-down features now described.

Figure 5:
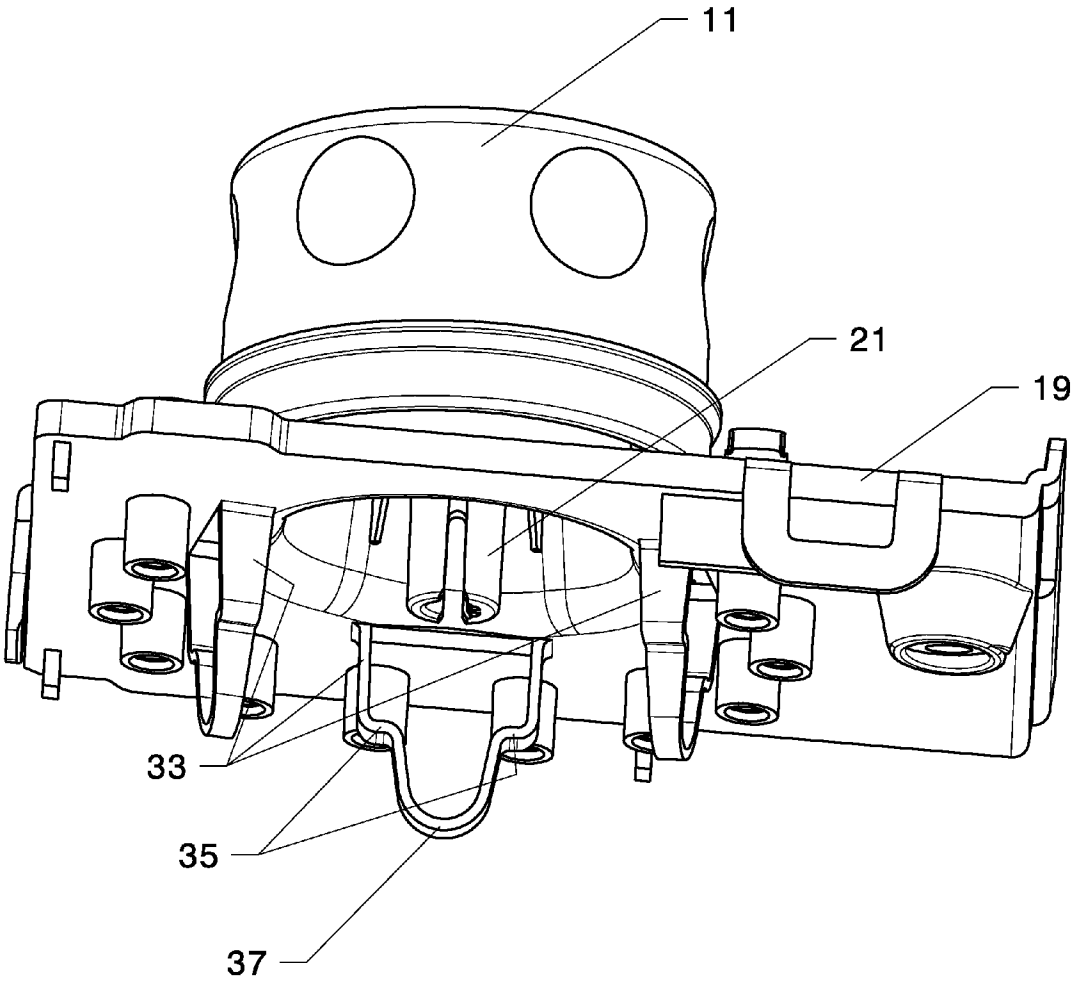
FIG. 5 is a view of the underside of the front housing with knob and bearing assembled, showing hold down elements which fix the position of the encoder mounting PCB within the rear housing upon completion of the assembly.

As illustrated by FIGS. 4 and 5, in order to fully fix the PCB 27 within the rear housing 24 upon full engagement of the knob shaft 21 with the encoder shaft 25, rearwardly protruding spring arms 33 of the front housing, come into contact with, and clamp, PCB 27 in place as the aforementioned sub-assembly advances into place on the rear housing 24. Such hold-down structures are sized and configured to engage with the PCB 27 after the knob shaft 21 and encoder shaft 25 are engaged, so that the encoder shaft 25 is allowed a degree of float to become properly aligned with the knob shaft 21 before its translational location becomes fixed.

As shown in the illustrated embodiment, there may be three spring arms 33, angularly spaced 120 degrees apart from each other around the axis of rotation of knob 11 (when it is mounted on the front housing 19), in order to evenly clamp the PCB 27 into place. Each of the spring arms 33 is symmetrically formed as two arm segments that emanate from two spaced points on the rear side of the front housing. The two segments extend parallel to each other a first equal distance, turn inwardly toward each other forming a pair of shoulders 35, then taper inwardly further until joining together centrally to form a closed loop and a rounded, rearwardly protruded end 37. It is this end that comes into engagement with PCB 27 (as seen in FIG. 3). This arm configuration allows the arm to elastically deform slightly upon the engagement to thereby give a leaf-spring like action which holds the PCB firmly without imparting excessive force that could damage it. Various other arrangements of hold-down structures may be used to fix the encoder's position within the rear housing once it has been brought into proper alignment.

FIG. 6 illustrates more clearly the seat for encoder mounting PCB 27. The PCB may sit on top of a semi-circular rib 39 after being clipped into spring clips 29. Rib 39 is semi-circular in order to avoid contacting sensitive conductive traces provided on the backside of the board. Various other support configurations may be provided, e.g., a full circular rib, in other embodiments. Additional support about the periphery of the board is provided by giving ribs 30 an L-shape such that the lower base part of each rib 30 provides a raised ledge upon which an edge portion of the board may rest. While not visible, a third spring clip 29 may be provided, e.g., equi-spaced from the other two about a circumference of the seat. One of those clips (which may optionally be provided as a rigid structure) may initially receive an edge portion of the PCB, whereafter the PCB 27 may be pivoted downwardly about that initial point of engagement so as to snap-clip in under the remaining spring clips 29. This results in the PCB being loosely retained within the clips 29 and atop rib 39, ready for the engagement of knob shaft 21 with encoder shaft 25, and the attendant position adjustment that can occur before the PCB 27 is firmly secured in place by spring arms 33.

In the illustrated embodiments, the control panel assembly and components are implemented in a control panel of an automated laundry washing machine. It will be understood, however, that aspects of the invention may be applied to other automatic washing/drying appliances, e.g., dishwashing machines, and to electronic appliances in general.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. An appliance control knob assembly, comprising:
an encoder that has a rotatable shaft;
a control knob connected to said rotatable shaft;
a control knob mounting protuberance that extends into the control knob and provides a bearing mounting surface; and
a bearing mounted on the bearing mounting surface, said control knob having a hub portion extending through said bearing and engaging with the same so as to be rotationally supported therein, said hub portion further engaging with the rotatable shaft of the encoder;
wherein the encoder is mounted within the assembly such that prior to attachment of the hub portion with the encoder shaft, the encoder is allowed a degree of movement whereby upon engagement of the hub portion with the encoder shaft, the encoder shaft comes into alignment with the hub portion and wherein said bearing is a rolling-element bearing comprising rolling elements rotatable within a circular race.

2. An appliance control knob assembly according to claim 1, wherein said bearing is a ball bearing comprising balls rotatable within said circular race.

3. An appliance control knob assembly according to claim 1, wherein the hub portion comprises a central bushing that is engaged with an inner race ring of the bearing to rotate therewith, said central bushing having a passage within which said encoder shaft is received.

4. An appliance control knob assembly, comprising:
an encoder that has a rotatable shaft;
a control knob connected to said rotatable shaft;
a control knob mounting protuberance that extends into the control knob and provides a bearing mounting surface; and
a bearing mounted on the bearing mounting surface, said control knob having a hub portion extending through said bearing and engaging with the same so as to be rotationally supported therein, said hub portion further engaging with the rotatable shaft of the encoder;
wherein the encoder is mounted within the assembly such that prior to attachment of the hub portion with the encoder shaft, the encoder is allowed a degree of movement whereby upon engagement of the hub portion with the encoder shaft, the encoder shaft comes into alignment with the hub portion and wherein the encoder is mounted on a printed circuit board (PCB) that is mounted within the assembly such that prior to attachment of the hub portion with the encoder shaft, the PCB is allowed a degree of movement, whereby upon engagement of the hub portion with the encoder shaft, the encoder shaft comes into alignment with the hub portion.

5. An appliance control knob assembly according to claim 4, wherein said bearing mounting surface is provided at least in part by a collar of the control knob mounting protuberance within which the bearing is secured.

6. An appliance control knob assembly according to claim 4, further comprising a chamfered surface provided on at least one of the encoder shaft and hub portion, that facilitates centering of the encoder shaft with the hub portion.

7. An appliance control knob assembly according to claim 4, further comprising a rear electronics enclosure housing, wherein the PCB is received within a cavity of said rear electronics enclosure housing, said cavity being larger than the PCB in at least one dimension to allow said degree of movement of the PCB.

8. An appliance control knob assembly according to claim 4, wherein the PCB is mounted so as to be allowed a degree of movement in the plane of the PCB prior to said engagement of the hub portion with the encoder shaft.

9. An appliance control knob assembly according to claim 8, further comprising at least one holding element that presses against said PCB and thereby serves to hold it in place after an initial engagement of the hub portion with the encoder shaft.

10. An appliance control knob assembly according to claim 9, wherein said control knob mounting protuberance is provided on a front electronics enclosure housing, the assembly further comprising a rear electronics enclosure housing engaged with said front electronics enclosure housing, within which said encoder is mounted, said at least one holding element being mounted on said front electronics enclosure housing.

11. A control knob assembly method comprising:

mounting a bearing on a bearing mounting surface of a control knob mounting protuberance;

mounting a control knob on said control knob mounting protuberance such that the protuberance extends into the control knob and a hub portion of said control knob extends through said bearing;

movably mounting an encoder within a support structure of a control panel assembly, said encoder having a rotatable shaft; and engaging the hub portion with the encoder shaft such that the engagement is able to move the encoder within said support structure to thereby center the shaft with the hub portion in the event of a misalignment of the shaft and hub portion;

wherein said bearing comprises rolling elements.

12. A control knob assembly method comprising:

mounting a bearing on a bearing mounting surface of a control knob mounting protuberance;

mounting a control knob on said control knob mounting protuberance such that the protuberance extends into the control knob and a hub portion of said control knob extends through said bearing;

movably mounting an encoder within a support structure of a control panel assembly, said encoder having a rotatable shaft; and engaging the hub portion with the encoder shaft such that the engagement is able to move the encoder within said support structure to thereby center the shaft with the hub portion in the event of a misalignment of the shaft and hub portion;

wherein the mounting of said encoder includes mounting a printed circuit board (PCB) with said encoder mounted thereon within said support structure.

13. The control knob assembly method of claim 12, wherein said mounting of said bearing comprises fixedly attaching said bearing in a collar provided by said mounting protuberance.

14. The control knob assembly method of claim 12, wherein said support structure comprises a rear housing of the control panel assembly, said rear housing having a cavity that is larger than the PCB in at least one dimension to thereby allow a degree of movement of the PCB prior to said engaging of the hub portion with the encoder shaft.

15. The control knob assembly method of claim 14, further including engaging holding elements with said PCB after an initial engagement of said hub portion with said encoder shaft.

16. The control knob assembly method of claim 15, wherein said holding elements are mounted on a front housing of the control panel assembly, and said engaging of the holding elements with the PCB comprises engaging the front housing with said rear housing.

17. The control knob assembly method of claim 16, further comprising pre-assembling said control knob and bearing on said protuberance, which is provided as a part of said front housing, prior to engaging said front housing with said rear housing.

18. The control knob assembly method of claim 16, wherein said mounting of said control knob comprises fixedly mounting said hub portion within an inner ring/race of said bearing.

* * * * *